US006676896B1

(12) United States Patent
Baumeister

(10) Patent No.: US 6,676,896 B1
(45) Date of Patent: Jan. 13, 2004

(54) COMPONENT COMPRISED OF A COMPOSITE MATERIAL CONTAINING A FORMABLE METALLIC MATERIAL AND METHOD FOR PRODUCING THE SAME

(75) Inventor: Joachim Baumeister, Bremen (DE)

(73) Assignee: Fraunhofer-Gesellschaft zur Foerderung der angwandten Forschung e.V., Munich (DE)

( * ) Notice: Subject to any disclaimer, the term of this patent is extended or adjusted under 35 U.S.C. 154(b) by 0 days.

(21) Appl. No.: 10/009,708

(22) PCT Filed: May 18, 2000

(86) PCT No.: PCT/DE00/01559

§ 371 (c)(1),
(2), (4) Date: Nov. 19, 2001

(87) PCT Pub. No.: WO00/71285

PCT Pub. Date: Nov. 30, 2000

(30) Foreign Application Priority Data

May 19, 1999 (DE) ..... 199 23 127

(51) Int. Cl.[7] ..... B22F 3/02; B32B 31/00

(52) U.S. Cl. ..... 419/61; 29/897; 29/897.2; 29/412; 148/514; 148/515; 148/516; 148/527; 148/529; 156/247; 156/344; 419/66; 419/69; 428/940

(58) Field of Search ..... 419/5, 6, 8, 61, 419/66, 69; 428/548, 553, 554, 555, 557, 559, 615, 650, 654, 660, 684, 940; 29/897, 897.2, 412; 148/514, 515, 516, 527, 529; 156/247, 344

(56) References Cited

FOREIGN PATENT DOCUMENTS

| | | | |
|---|---|---|---|
| DE | 41 01 630 | 12/1991 | ..... B22F/3/18 |
| DE | 44 26 627 | 2/1995 | ..... B22F/7/04 |
| DE | 195 01 659 | 5/1996 | ..... C22C/1/08 |
| DE | 197 04 968 | 7/1998 | ..... F17C/1/02 |
| FR | 615147 | 10/1926 | |
| WO | WO 97/31739 | 9/1997 | ..... B22F/3/14 |
| WO | WO-97/31739 A1 * | 9/1997 | ..... B22F/3/14 |

OTHER PUBLICATIONS

Forschungsbericht P 281.1 Industrielle Nutzung von Stahlblechverbundwerkstoffen mit geschaeumtem Aluminium (Research Report P 281.1 Industrial Use of Steel Sheet Compound Materials with Foamed Aluminum); no page numbers; no date.

* cited by examiner

*Primary Examiner*—Robert R. Koehler
(74) *Attorney, Agent, or Firm*—Karl Hormann

(57) ABSTRACT

The invention relates to a method of a composite material from superposed layers of solid and frothable metallic materials. The structural component consists of at least one layer of a solid metallic material and at least one layer of frothable metallic material. The structural component may be structured as a composite sheet or as a hollow body. The fabrication method of the structural component insures a good bond between the solid metallic layer and the frothable layer and that the frothable layer is securely attached to the solid metallic layer.

10 Claims, 4 Drawing Sheets

COMPONENT COMPRISED OF A COMPOSITE MATERIAL CONTAINING A FORMABLE METALLIC MATERIAL AND METHOD FOR PRODUCING THE SAME

BACKGROUND OF THE INVENTION

1. Field of the Invention

The invention relates to a method of fabricating composite structural components from layers of solid metallic materials and frothable metallic materials.

2. The Prior Art

Light structural components such as, for instance, hollow bodies, provided with two cover layers made of a solid metallic material and a layer of metallic foam placed between them are known. Being of light weight these structural components are characterized by a particularly high rigidity and strength. From German patent specification DE 41 01 630 it is known to fill hollow bodies with frothing aluminum and that the frothing process is carried out in the interior of the hollow body. This results in a particularly light structural component. The connection between the foam filler and the hollow body may be impeded by the presence of oxide layers on all surfaces of the hollow body and on the surface of the expanding foam.

Sandwich-like composite materials may also be fabricated by adhesively affixing cover layers of solid metallic material to bodies of foamed aluminum. These, however, suffer from the lack of strength of the adhesives, especially at high temperatures. Composite materials are known from German patent specification 44 26 627 which are fabricated by roll coating frothable aluminum with liners of solid metallic material such as, for instance, steel, aluminum or titanium, followed by frothing of the frothable aluminum. Hollow bodies made by this process are provided at their exterior and at their interior with a cover layer of solid metallic material. The internal cover layer contributes little, however, to the rigidity and strength of the component; yet it does increase the total weight of the component.

OBJECTS OF THE INVENTION

It is the task of the present invention to provide a structural component which is of high rigidity and strength, but of low weight. Another task of the invention resides in a method of fabricating such a component.

The task is accomplished by the method hereinafter described in greater detail.

SUMMARY OF THE INVENTION

In accordance with the invention, a structural component is provided which is provided with a layer of solid metallic material and of which at least one surface is formed by a frothable metallic substance. This surface may be either the external or the internal surface. The component may be structured as a planar composite sheet or as a hollow body. The method of fabricating this component insures an excellent connection between the solid metallic cover layer and the frothable layer and a strong bond between the frothable layer and the cover layer.

A component formed as a planar composite sheet may consist of a solid metallic layer and a layer of a frothable metallic substance strongly adhering thereto. Such composite sheets are particularly suitable as side impact protection bars of automotive passenger vehicle doors. Such a side impact protection bar thus consists of a hollow profile on the interior surface of which there is provided a strongly adhering metallic foam which while significantly contributing to the rigidity and strength of the component contributes but little to its weight.

In another structure of the composite sheets the component consists of several layers of a solid substance and intermediate layers of a frothable metallic substance wherein both or only one surface of a composite sheet structured in this manner may be formed of a layer of frothable metallic material. In another embodiment of the invention, a composite sheet is provided with a layer solid metallic material positioned between two frothable layers. Such a composite sheet exhibits an especially high rigidity and strength at a very low weight.

The structural components in accordance with the invention with an asymmetric layer sequence are preferably fabricated by pack rolling. This involves alternatingly arranging layers of a solid metallic material and layers of frothable metallic material in superposition. The invention also provides for using loose powder mixtures containing a blowing agent or precompacted (e.g. by cold isostatic pressing) powder mixtures instead of the finished frothable layers. In such cases one or more connected, continuous non-porous separating foils are used as release agents in view of the fact that otherwise emulsions may become intermingled with the loose or precompacted powder mixture. In such cases the loose or precompacted powder mixtures are not condensed to frothable layers before the cladding and laminating process. Fusion during the roll process between the frothable layers which are part of individual composite sheets is prevented by the provision of a release agent such as, e.g. an emulsion of graphite or boron nitrite, or by a separating foil, between the layers. A foil is used as the release agent where the frothable layer is a powder mixture containing a blowing agent. The packets thus formed are then subjected to a rolling process. The result of the rolling process are components with frothable layers on their surfaces, the components being separated by the release agents between the frothable layers.

Provided they result in a good bond between the frothable metal layer and the cover layer of solid metallic material, other known cladding and laminating processes may also be utilized. They may be drawing, thermal extrusion, explosive cladding, coextrusion, extrusion cladding or HIP cladding processes.

The quality of the bond of composite materials fabricated by the method in accordance with the invention is such that the planar composite material sheets may be cold-formed or further processed into hollows with longitudinal welding seams. To fabricate irregularly shaped hollow components such as, e.g. tanks and transverse links, the planar composite sheets may first be shaped by any desired forming processes such as pressing, deep drawing or cavity pressure forming, before finishing the desired hollow body.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DESCRIPTION OF PREFERRED EMBODIMENTS

Figure 1:
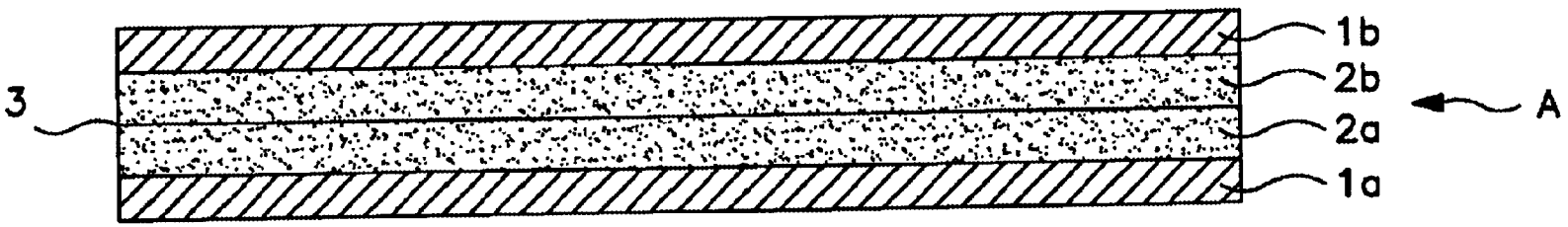
FIG. 1 depicts an arrangement of the materials for fabricating planar composite sheets by roll cladding.

FIG. 1 depicts an arrangement of the materials during fabrication of planar composite sheets with only one solid metallic cover layer 1*a*, 1*b* and a frothable layer 2*a*, 2*b*. For fabricating such composite sheets, the starter materials are arranged in symmetric stacks of plates A. A layer 2*a* of a metallic frothable material is applied to a cover layer 1*a* of a solid metallic material. A release agent 3 is put on the layer 2*a*. A further layer 2*b* of frothable metallic material and a further cover layer 1*b* of solid metallic material are applied on the release agent layer 3. Such plate stacks A are subjected to a roll cladding process. This results in bonding of each cover layer 1*a, b* with the adjacent frothable layer 2*a, b*. Bonding between the frothable layers 2*a*, 2*b* is, however, prevented by the release agent 3. The result of the roll cladding process is two planar composite material sheets, each consisting of a cover layer 1*a, b* and a frothable layer 2*a, b* rigidly bonded thereto. A composite sheet fabricated in this manner may also be structured three-dimensionally. The quality of the bond between the two layers 1 and 2 is such that they are nor separated by further processing by conventional methods such as, for instance, pressing, deep drawing, cavity pressure shaping etc.

Figure 2:
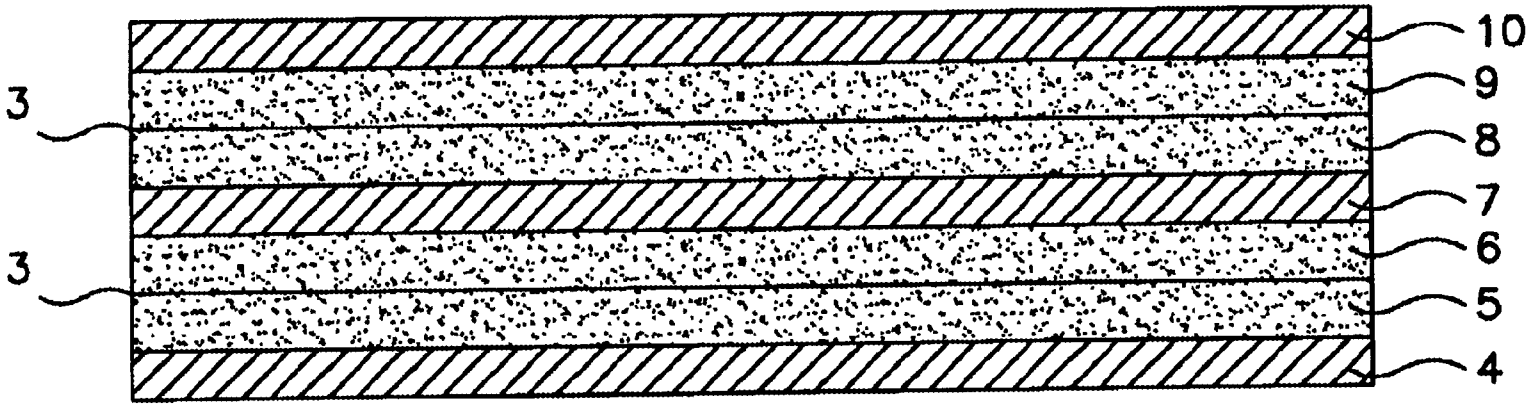
FIG. 2 is another arrangement of the materials of FIG. 1.

FIG. 2 depicts another arrangement for fabricating composite sheets by a pack rolling process. The layers are arranged as follows: A layer 5 of frothable material is applied to a cover layer 4 of solid metallic material. A release agent layer 3 is applied on layer 5 and a further layer 6 of a frothable material is applied to the release agent layer 3. The layer 6 is followed by a layer 7 of solid metallic material which is in turn covered by a layer 8 of frothable material followed by a release agent layer 3. Upon this release agent layer 3, there is applied a layer of frothable material 9 followed by a cover layer 10 of solid metallic material. The packet is subjected to a roll cladding process. The output of the roll cladding process is: two composite sheets 4, 5; 9,10 covered on one surface by a layer of frothable material, and one composite sheet 6, 7, 8 covered on both surfaces by a frothable material.

Figure 3:
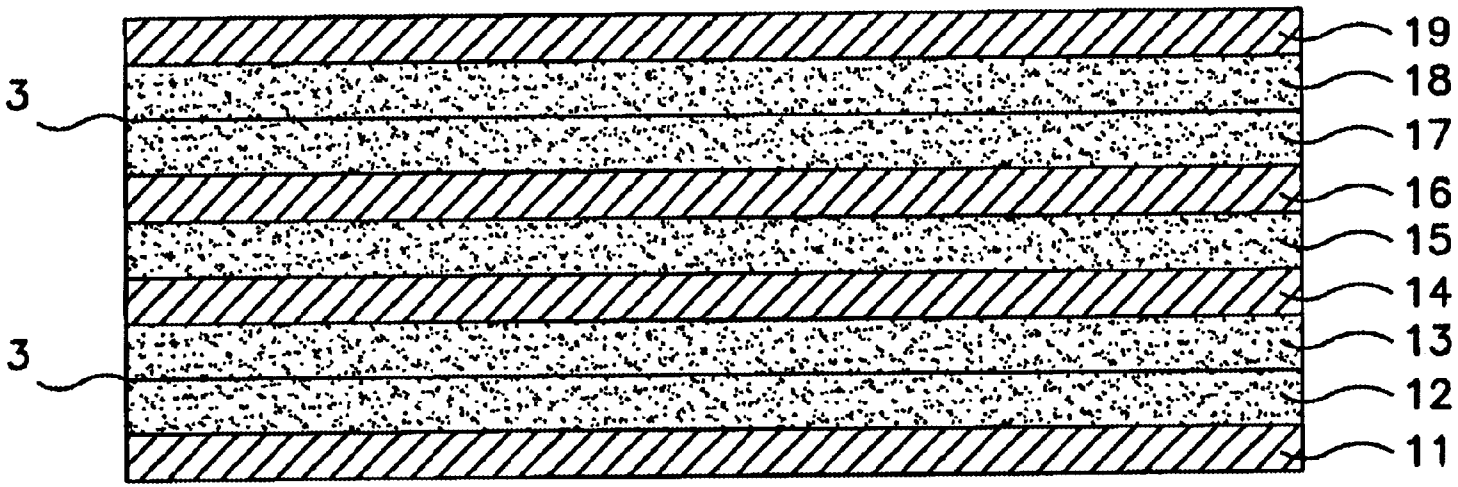
FIG. 3 is a further arrangement of the materials of FIG. 1.

FIG. 3 depicts a layer sequence in which a sandwich structure (a frothable layer placed between two cover layers) is additionally coated with a frothable layer on one or both surfaces. This results in the following arrangement of layers: solid metallic material 11, frothable material 12, release agent 3, frothable material 13, solid metallic material 14, frothable material 15, solid metallic material 16, frothable material 17, release agent 3, frothable material 18, solid metallic material 19. Roll cladding this packet results in two composite sheets 11, 12; and 18, 19 covered on one surface with a frothable layer, and a sandwich structure of two solid cover layers 14, 16 provided on their surfaces with a frothable material 13, 17 and a frothable material 15 between the cover layers 14, 16. If in the arrangement of FIG. 3 the layers 11, 12, 3 and 13 are eliminated, the result will be a sandwich structure 14, 15, 16 covered on one surface by a frothable layer 17, and a composite sheet 18, 19 covered on one surface by a frothable layer 18.

Figure 4:
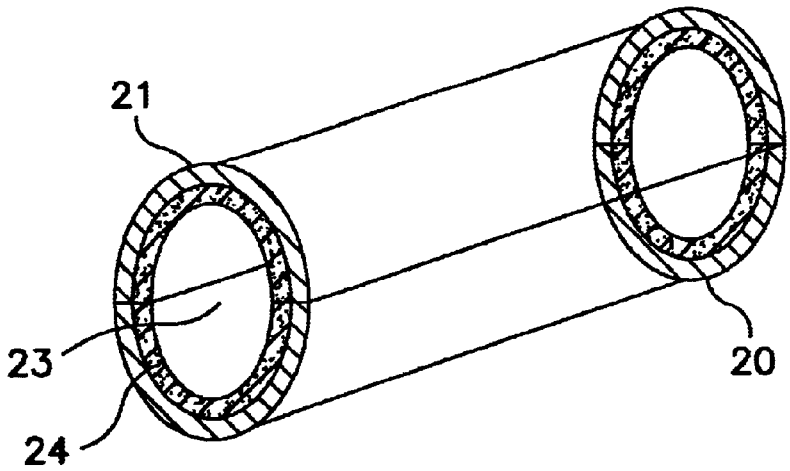
FIG. 4 is a hollow body with a cover layer and a frothable layer.
Figure 5:
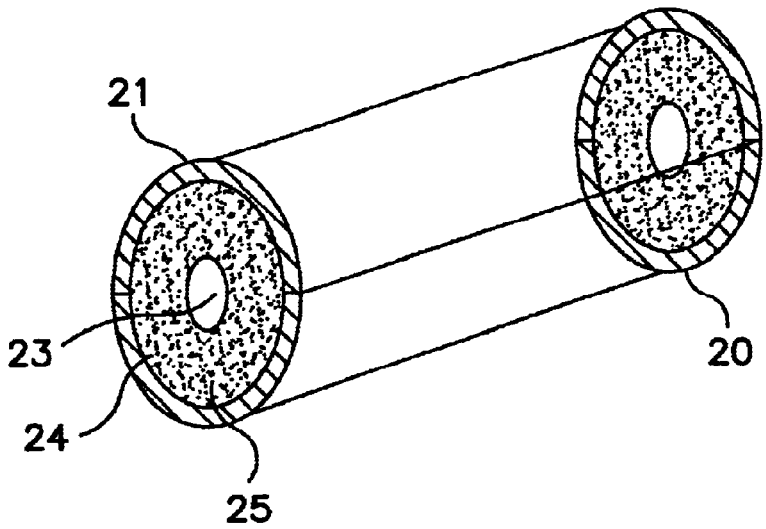
FIG. 5 depicts the hollow body of FIG. 4 with the frothed layer.

As shown in FIGS. 4 and 5, the composite sheets described hereinabove may, by deep drawing, be shaped into three-dimensionally bent semi bowls 20, 21. Superposing these semi bowls 20, 21 such that a cavity 23 is formed between them with the frothable layers 24 facing each other, and if frothing is then carried out by application of heat, the two frothable layers will bond together at their interfaces, so that after cooling, the two semi bowls 20, 21 will be inseparably connected by the metal foam 25. Another possibility is during the frothing process to press the semi bowls against each other, as by screws or clamping devices. In that case, the engagement pressure prevents frothing at the interfaces so that the two semi shells will be inseparably connected to each other by a solid non-frothed layer of aluminum. At the same time, the foam could unimpededly expand at the other internal surfaces. A further possibility of fabricating a hollow component to weld the two semi shells 20, 21 together before or after frothing, so that in the welded zone the metal layers of conventional materials are directly connected to each other without foam or frothed material being present therein. Finally, it is possible, to fabricate uniformly shaped articles (e.g. simple tubes) and further to process them, for instance by cavity pressure forming.

The frothing process is often is the last step by the hollow body being heated to a temperature at which the frothable aluminum layer 24 is expanded to a layer 25 of foam. It is also possible, however, first to carry out frothing and thereafter to undertake any forming steps.

It is of advantage, to carry out the frothing process by heat treatment of the cover layer material.

In individual cases frothing may deliberately be carried out such that the entire internal space of a hollow component is filled by foam.

What is claimed is:

1. A method of fabricating a composite structural component, comprising the steps of:

providing at least first and second layers of solid metallic material;

interposing between the at least first and second layers of solid metallic material at least third and fourth layers of frothable metallic material containing a blowing agent;

interposing between the at least third and fourth layers a release agent;

subjecting the first, second, third and fourth layers and the release agent to a compressive rolling process to attach the first layer to one of the third and fourth layer, and the second layer to the other of the third and fourth layers; and separating the at least third and fourth layers By the release layer thereby to obtain at least first and second composite structural components comprising the first layer and one of the at least third and fourth layers and the second layer and the other of the at least third and fourth layers.

2. The method of claim 1, further comprising the step of forming the at least third and fourth layers from a loose powder mixture containing a blowing agent during the rolling process.

3. The method of claim 1, further comprising the step of forming the at least third and fourth layers from a precompacted powder mixture containing a blowing agent.

4. The method of claim 1, wherein the release agent comprises an emulsion of one of graphite and boron nitride.

5. The method of claim 1, wherein the release agent comprises a release foil.

6. The method of claim 1, wherein the at least first and second layers comprise one of steel, aluminum and titanium.

7. The method of claim 1, wherein the at least third and forth layers comprise aluminum.

8. The method of claim 1, wherein said compressive force is applied as at least one of roller cladding, drawing, explosive cladding, HIP cladding, extrusion cladding and coextrusion.

9. The method of claim 1, further comprising the step of further processing at least one of the first and second composite structural components.

10. The method of claim 9, wherein the further processing comprises at least one of pressing, cavity pressure forming and deep drawing.

* * * * *